US010276042B2

(12) United States Patent
Paruch et al.

(10) Patent No.: US 10,276,042 B2
(45) **Date of Patent: *Apr. 30, 2019**

(54) DYNAMICALLY CONFIGURABLE TRAFFIC CONTROLLERS AND METHODS OF USING THE SAME

(71) Applicant: Rite-Hite Holding Corporation, Milwaukee, WI (US)

(72) Inventors: Lucas I. Paruch, Dubuque, IA (US); Aaron J. Wiegel, Benton, WI (US); Jason Dondlinger, Bellevue, IA (US); Ronald P. Snyder, Dubuque, IA (US); Joe Korman, Dubuque, IA (US); David Swift, Dubuque, IA (US); Charles Waugaman, Mequon, WI (US); James Oates, Mequon, WI (US); Peter D. Nygaard, Menomonee Falls, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/967,123

(22) Filed: Apr. 30, 2018

(65) Prior Publication Data

US 2018/0247531 A1 Aug. 30, 2018

Related U.S. Application Data

(63) Continuation of application No. 14/931,844, filed on Nov. 3, 2015, now Pat. No. 10,055,986.

(51) Int. Cl.
*G08G 1/095* (2006.01)
*G08G 1/005* (2006.01)
(Continued)

(52) U.S. Cl.
CPC ..... *G08G 1/095* (2013.01); *G08G 1/005* (2013.01); *G08G 1/01* (2013.01); *G08G 1/07* (2013.01); *G08G 1/081* (2013.01)

(58) Field of Classification Search
CPC ..... H04W 4/00; G06F 2101/00
See application file for complete search history.

(56) References Cited

U.S. PATENT DOCUMENTS 4,746,910 A * 5/1988 Pfister ..... G08B 13/19 250/340
4,928,101 A 5/1990 Favors
(Continued)

FOREIGN PATENT DOCUMENTS

CN 204066387 12/2014
EP 1775692 4/2007
(Continued)

OTHER PUBLICATIONS

International Searching Authority, "International Search Report and Written Opinion," issued in connection with PCT Application No. PCT/US2016/050565, dated Feb. 2, 2017, 20 pages.
(Continued)

*Primary Examiner* — Shirley Lu
(74) *Attorney, Agent, or Firm* — Hanley, Flight and Zimmerman, LLC

(57) ABSTRACT

Dynamically configurable traffic controllers and methods of using the same are disclosed. An example apparatus includes a first sensor to face a first direction to detect oncoming traffic in a first area, a second sensor to face a second direction to detect oncoming traffic in a second area, and a first display to face the first area. The first display is to display a first signal in response to (1) the first sensor not detecting the oncoming traffic in the first area and (2) the second sensor detecting the oncoming traffic in the second area. The first display is to display a second signal in
(Continued)

response to (1) the first sensor detecting the oncoming traffic in the first area and (2) the second sensor detecting the oncoming traffic in the second area. The first signal is different than the second signal.

20 Claims, 11 Drawing Sheets

(51) Int. Cl.

| | |
|---|---|
| ***G08G 1/01*** | (2006.01) |
| ***G08G 1/07*** | (2006.01) |
| ***G08G 1/081*** | (2006.01) |

(56) References Cited

U.S. PATENT DOCUMENTS

| | | | | |
|---|---|---|---|---|
| 5,461,231 | A | 10/1995 | Sugimoto et al. | |
| 5,572,202 | A | 11/1996 | Regel et al. | |
| 6,307,484 | B1 | 10/2001 | Sasaki et al. | |
| 6,762,689 | B2 | 7/2004 | Dechape | |
| 6,784,800 | B2 | 8/2004 | Orzechowski | |
| 7,408,479 | B2 | 8/2008 | Johnson | |
| 2002/0190849 | A1 | 12/2002 | Orzechowski | |
| 2005/0151670 | A1* | 7/2005 | Johnson | G08G 1/07 340/907 |
| 2005/0280553 | A1 | 12/2005 | DiPiazza | |
| 2006/0137261 | A1 | 6/2006 | Maly | |
| 2006/0146520 | A1 | 7/2006 | Vitense et al. | |
| 2007/0276600 | A1 | 11/2007 | King et al. | |
| 2009/0256721 | A1 | 10/2009 | Glatfelter | |
| 2010/0283631 | A1 | 11/2010 | Bryant | |
| 2011/0260846 | A1 | 10/2011 | Mochizuki et al. | |
| 2011/0260888 | A1 | 10/2011 | Fossier et al. | |
| 2012/0025964 | A1 | 2/2012 | Beggs et al. | |
| 2013/0253816 | A1 | 9/2013 | Caminiti et al. | |
| 2013/0257607 | A1 | 10/2013 | Rigby et al. | |
| 2015/0154863 | A1 | 6/2015 | Fossier et al. | |
| 2017/0124867 | A1 | 5/2017 | Paruch et al. | |

FOREIGN PATENT DOCUMENTS

| | | |
|---|---|---|
| GB | 2119987 | 11/1983 |
| KR | 20130066389 | 6/2013 |
| WO | 2005020180 | 3/2005 |

OTHER PUBLICATIONS

International Searching Authority, "Invitation to pay additional fees," issued in connection with PCT Application No. PCT/US2016/050565, dated Dec. 12, 2016, 8 pages.
Shurestar, "You Are Now Entering the Safety Zone Intersection Caution Systems & Alerts," Brochure, 5 pages.
Collision Awareness, "Look Out—Leaders of Intersection Protection," Brochure, 12 pages.
Shurestar, "Traffic Caution Systems," 2015, [http://shurestar.com/traffice-caution-systems/], retrieved on Sep. 28, 2015, 2 pages.
United States Patent and Trademark Office, "Requirement for Restriction and/or Election," issued in connection with U.S. Appl. No. 14/931,844, dated Nov. 14, 2017, 7 pages.
United States Patent and Trademark Office, "Notice of Allowance and Fee(s) Due," issued in connection with U.S. Appl. No. 14/931,844, dated Feb. 8, 2018, 7 pages.
Zone Safe, "Walkway Alert Pedestrian Warning System," retrieved from [https://www.zonesafe.net/proximity-warning-system-applications/walkway-alert-system/] on May 31, 2018, 2 pages.
Hit-Not, "Hit-Not Proximity Detection Parts Catalog," retrieved from [https://hitnot.com/wp-content/uploads/2016/08/Parts-CatalogCurrent2-11-16.pdf] on May 31, 2018, 21 pages, 2016.
Cisco-Eagle, "AisleAlert Forklift SafetyWarning Systems," retrieved from [http://www.cisco-eagle.com/catalog/category/9174/aislealert-traffic-floor-light-systems] on May 31, 2018, 8 pages.
Save-ty, "Save'ty Yellow Products," retrieved from [https://safety-products.save-ty.com/category/roducts-collision-awareness-look-outs-look-out-3-4], on May 31, 2018, 3 pages, 2017.
Sky-Trax, "Fork Alert," retrieved from [http://www.totaltraxinc.com/attachments/article/35/forkalertspecs.pdf] on May 31, 2018, 2 pages.
Tapco, "Forklift Traffic Warning System," retrieved from [https://www.tapconet.com/solar-led-division/industrial-forklift-traffic-blinkersign/] on May 31, 2018, 2 pages.
Sentry Protection Products, "Collision Sentry Always on Guard," retrieved from [http://www.sentrypro.com/pages/support_files/2013-CollisionSentry_Brochure.pdf] on May 31, 2018, 4 pages, 2013.
Crossing Guard, "Crossing Guard Forklift Collision Alert System," retrieved from [http://crossingguardsafety.com/2012-02-24-17-41-10/finish/1-click-for-crossing-guard-pdf-files/2-crossing-guard-4-page-brochure/0.html] on May 31, 2018, 4 pages.
Canadian Intellectual Property Office, "Examination Report," issued in connection with Canadian Application No. 3,004,289, dated Feb. 14, 2019, 4 pages.
European Patent Office, "Invitation Pursuant to Rule 137(4) EPC and Article 94(3) EPC)," issued in connection with European Application No. 16767113.0, dated Feb. 11, 2019, 3 pages.

* cited by examiner

1300

| Inputs | | | | Outputs | | | |
|---|---|---|---|---|---|---|---|
| North | East | South | West | North | East | South | West |
| OFF | OFF | OFF | OFF | OFF | OFF | OFF | OFF |
| OFF | OFF | OFF | ON | *Amber* | *Amber* | *Amber* | OFF |
| OFF | OFF | ON | OFF | *Amber* | *Amber* | OFF | *Amber* |
| OFF | OFF | ON | ON | *Amber* | *Amber* | Red | Red |
| OFF | ON | OFF | OFF | *Amber* | OFF | *Amber* | *Amber* |
| OFF | ON | OFF | ON | *Amber* | Red | *Amber* | Red |
| OFF | ON | ON | OFF | *Amber* | Red | Red | *Amber* |
| OFF | ON | ON | ON | *Amber* | Red | Red | Red |
| ON | OFF | OFF | OFF | OFF | *Amber* | *Amber* | *Amber* |
| ON | OFF | OFF | ON | Red | *Amber* | *Amber* | Red |
| ON | OFF | ON | OFF | Red | *Amber* | Red | *Amber* |
| ON | OFF | ON | ON | Red | *Amber* | Red | Red |
| ON | ON | OFF | OFF | Red | Red | *Amber* | *Amber* |
| ON | ON | OFF | ON | Red | Red | *Amber* | Red |
| ON | ON | ON | OFF | Red | Red | Red | *Amber* |
| ON | ON | ON | ON | Red | Red | Red | Red |

FIG. 13

DYNAMICALLY CONFIGURABLE TRAFFIC CONTROLLERS AND METHODS OF USING THE SAME

RELATED APPLICATIONS

This patent arises from a continuation of U.S. patent application Ser. No. 14/931,844 know U.S. Pat. No. 10,055,986) filed on Nov. 3, 2015, and which is hereby incorporated herein by reference in its entirety.

FIELD OF THE DISCLOSURE

This disclosure relates generally to traffic controllers, and, more particularly, to dynamically configurable traffic controllers and methods of using the same.

BACKGROUND

Industrial settings, such as warehouses, may include traffic and/or pedestrian intersections. In some instances, these intersections are used by both vehicles and pedestrians.

BRIEF DESCRIPTION OF THE DRAWINGS

FIG. 13 illustrates example inputs and outputs of the example traffic controllers disclosed herein.

The figures are not to scale. Wherever possible, the same reference numbers will be used throughout the drawing(s) and accompanying written description to refer to the same or like parts.

DETAILED DESCRIPTION

Figure 1:
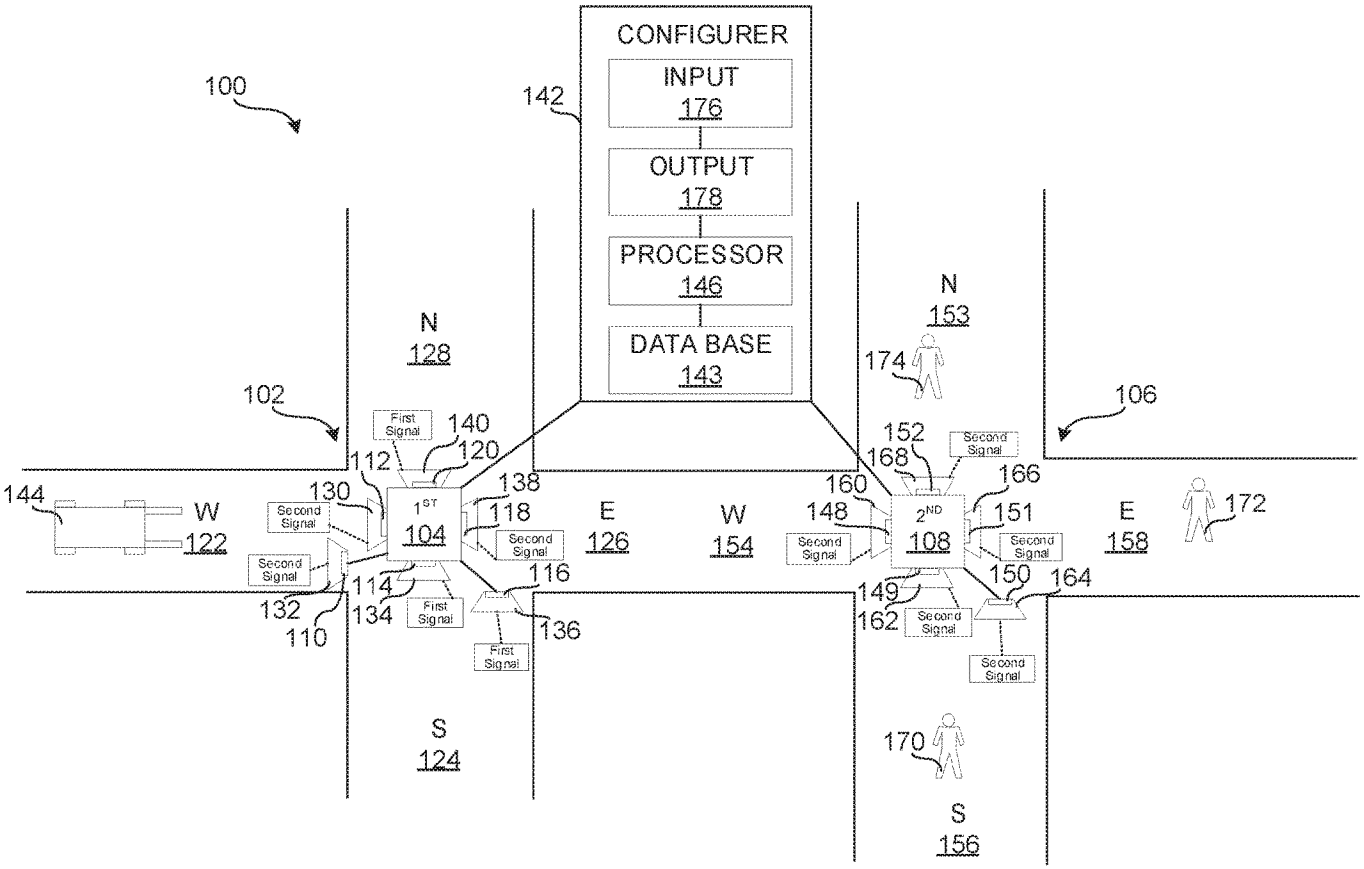
FIG. 1 illustrates an example floor plan including example first and second traffic controllers.

Conditions may be present in industrial settings (e.g., factories and/or warehouses) that may place pedestrians and vehicle (e.g., fork trucks and/or other material handling equipment) in close proximity to one another. Potential collision hazards may occur when vehicles and pedestrians are in close proximity to one another. An example potential collision hazard may be present when a fork truck and a pedestrian are both approaching the same intersection.

To reduce the possibility of collisions between vehicles and pedestrians and/or between vehicles, the examples disclosed herein relate to example dynamically configurable traffic controllers that provide different warning levels based on a detected danger and/or a potential collision hazard. In some examples, when a fork truck is detected approaching an intersection, the examples disclosed herein provide a first warning level in a direction(s) in which no other pedestrians or vehicles are approaching and a second warning level in a direction(s) in which a pedestrian(s) and/or another vehicle(s) is approaching. Thus, when a pedestrian and/or vehicle is approaching an intersection, the examples disclosed herein provide different warning levels (e.g., a caution warning, a danger warning) based on both the presence or absence of pedestrians and/or vehicles approaching the intersection in one direction or more than one direction.

In other words, when a pedestrian and/or vehicle is approaching an intersection, the example traffic controllers provide a first warning level in directions in which no traffic and/or pedestrians are detected and provide a second warning level in directions that pedestrians (e.g., traffic) and/or vehicles (e.g., traffic) are detected. In response to the vehicles and/or the pedestrians no longer being detected, the example traffic controllers provide different outputs (e.g., no warnings).

In some examples, the first warning level may be conveyed as a first shape (e.g., a triangle) and a first color (e.g., yellow) and the second warning level may be conveyed as a second shape (e.g., an octagon) and a second color (e.g., red). However, any other warning level and/or indication may be provided. For example, the different warning levels may include a flashing signal(s), an audible signal(s), a rotating beacon(s), etc.

In some examples, to provide additional and/or alternative signaling to a vehicle and/or a pedestrian, a warning(s) may be projected from the example traffic controllers onto the floor or onto any other object. In some examples, the projection may include an illuminated shape, an illuminated symbol, a solid signal, a flashing signal, a combination of a solid signal and a flashing signal, a pictographic warning symbol, etc. In some examples, the projector and/or projection source (e.g., the traffic controller) may be wall mounted, ceiling mounted and may be implemented using lights, high intensity light-emitting diodes (LED), lasers, etc.

While the example traffic controllers may be independently operable (e.g., not communicatively coupled to other traffic controllers), in some examples, the example traffic controllers may be communicatively coupled to enable a first traffic controller to provide input to a second traffic controller to initiate an output from the second traffic controller and for the second traffic controller to provide input to the first traffic controller to initiate an output from the first traffic controller. For example, when an oncoming vehicle is identified approaching a first traffic controller from the North, the first traffic controller and/or the second traffic controller may cause warning signals to be displayed at the South side of the first traffic controller, the East side of the first traffic controller, the West side of the first traffic controller and the East side of the second traffic controller. However, any additional or alternative warning signals may be displayed in any direction. In other examples, when an oncoming vehicle is identified approaching a first traffic controller from the North and an oncoming vehicle is identified approaching a second traffic controller from the East, the first traffic controller and/or the second traffic controller may cause a danger signal to be displayed at the North side of the first traffic controller and the East side of the first traffic controller and for warning signals to be displayed at the South side of the first traffic controller and the West side of the first traffic controller. Additionally, because the first and second traffic controllers are communicatively coupled in this example, the first traffic controller and/or the second traffic controller may cause a danger signal to be displayed at the East side of the second traffic controller and the West side of the second traffic controller and for warning signals to be displayed at the South side of the second traffic controller and the North side of the second traffic controller.

In some examples, to enable the examples disclosed herein to be dynamically configurable, inputs may be received that identify which sensor inputs influence which display outputs. For example, a North sensor input from a first traffic controller may be identified to influence and/or cause a warning signal and/or a danger signal to be displayed at an East display output of a second traffic controller. For example, a North sensor input from a first traffic controller may be identified to influence and/or cause a warning signal and/or a danger signal to be displayed at an East display output of the first traffic controller. In some examples, after the example traffic controllers are dynamically configured, example simulations may be run to enable a user to verify the configurations.

In some examples, the example traffic controllers are enclosed (e.g., fully enclosed) and/or include an integrated sensor(s). In some examples, the sensors detect and/or distinguish between a pedestrian approaching the sensor(s) and a vehicle(s) approaching the sensor. In examples in which the sensors distinguish between vehicles and pedestrians, when two pedestrians are detected approaching an intersection from different directions and no vehicles are detected approaching the intersection, the example traffic controllers may cause the first warning level to be conveyed as opposed to the heightened second warning level. However, any additional warning signal may be displayed in any direction.

In some examples, the examples disclosed herein provide a selectable option(s), via an input, user interface or otherwise, that enables the sensors and/or the processers disclosed herein to perform different actions when the example sensors and/or the processors differentiate between pedestrians and vehicles. For example, a user can select, using an example user interface, a first option in which no signals (e.g., the first signal, the second signal) are provided when pedestrians are identified as approaching the example traffic controls and no other vehicles are identified as approaching the example traffic controllers. In some examples, a user can select, using an example user interface, a second option in which signals (e.g., the first signal, the second signal) are provided when pedestrians are identified as approaching the example traffic controls and no other vehicles are identified as approaching the example traffic controllers.

In some examples, multiple sensors and/or display outputs may be positioned to face a particular direction. For example, an example first traffic controller may include a first display output and a first sensor facing a first direction and an example second traffic controller may include a second display output and a second sensor facing the first direction. In some examples, the first traffic controller is ceiling mounted and the second traffic controller is floor mounted. In some examples, the example displays are directly mounted to the floor such that the display(s) projects a signal (e.g., the first signal, the second signal) upward. In some examples, the displays are embedded into and/or integral to the flooring. For example, lights of the display may be positioned within apertures of the floor. In some examples, the displays are coupled to and/or part of a mat or floor covering that is positioned on the floor. In some examples, the first and second sensors are capable of detecting the presence of vehicles and/or pedestrians in different ranges and/or different zones. For example, the first sensor may be capable of detecting an approaching vehicle and/or pedestrian at a greater distance from the intersection than the second sensor and the second sensor may be capable of detecting an approaching vehicle and/or pedestrian at a greater width relative to the intersection than the first sensor. In some examples, the first display may be more visible to a fork truck driver due to the first traffic controller being mounted at a greater height than the second traffic controller while the second traffic controller may be more visible to a pedestrian due the second traffic controller being mounted at a lesser height than the first traffic controller.

FIG. 1 illustrates an example floor plan 100 including a first intersection 102 at which an example first traffic controller 104 is positioned and a second intersection 106 at which an example second traffic controller 108 is positioned. In the illustrated example, to detect approaching vehicles and/or pedestrians (e.g., traffic), the first traffic controller 104 includes a first sensor 110, a second sensor 112, a third sensor 114, a fourth sensor 116, a fifth sensor 118 and a sixth sensor 120 facing respective directions 122, 124, 126, 128. In some examples, the sensors 110, 112, 114, 116, 118, 120 differentiate between traffic approaching the first traffic controller 104 and traffic departing from the first traffic controller 104. In some examples, the sensors 110, 112, 114, 116, 118, 120 differentiate between vehicles and pedestrians approaching the first traffic controller 104. The sensors 110, 112, 114, 116, 118, 120 may be implemented by any suitable sensor and/or technology including, for example, microwave sensors (e.g., 2.4 GHz microwave sensors), photo sensors, infrared sensors, capacitive sensors, inductive sensors, sensors performing video analytics, etc. While two sensors are illustrated facing the West 122 and the South 124 and one sensor is illustrated facing the East 126 and the North 128, any number of sensors (e.g., 1, 2, 3, 4, etc.) may be provided to detect oncoming traffic in any direction.

In the illustrated example, to provide notice and/or warning indicative of approaching traffic (e.g., vehicle traffic, pedestrian traffic, etc.), the first traffic controller 104 includes a first display output 130, a second display output 132, a third display output 134, a fourth display output 136, a fifth display output 138 and a sixth display output 140 facing the respective directions 122, 124, 126, 128. While two display outputs are illustrated facing the West 122 and the South 124 and one display output is illustrated facing the East 126 and the North 128, any number of display outputs (e.g., 1, 2, 3, 4, etc.) may be provided in any direction to provide notice of oncoming traffic and/or to display any other data.

In some examples, the display outputs 130, 132, 134, 136, 138, 140 provide different signals and/or displays depending on the traffic identified and/or based on an association and/or relationship between the sensors 110, 112, 114, 116, 118, 120 and the display outputs 130, 132, 134, 136, 138, 140. In some examples, an association and/or relationship between the display outputs 130, 132, 134, 136, 138, 140 and the sensors 110, 112, 114, 116, 118, 120 is defined by an example traffic controller configurer 142 and stored in an example database 143 of the configurer 142. The relationships may define actions taken by one or more of the display outputs 130, 132, 134, 136, 138, 140 in response to received inputs from one or more of the sensors 110, 112, 114, 116, 118, 120. For example, a relationship between the first sensor 110 and the third display 134 may cause the third display 134 to display data and/or a signal (e.g., a first signal, a second signal) in response to an input received from the first sensor 110.

In some examples, a user may use the configurer 142 to define and/or identify the relationships between the display outputs 130, 132, 134, 136, 138, 140 and the sensors 110, 112, 114, 116, 118, 120. In some examples, the configurer 142 may define and/or identify the relationships between the display outputs 130, 132, 134, 136, 138, 140 and the sensors 110, 112, 114, 116, 118, 120 without user input using, for example, pre-defined relations and/or default settings stored in the database 143. In some examples, the first traffic controller 104 includes a first configurer and the second traffic controller 108 includes a second configurer different from the first configurer. However, in the illustrated example, the configurer 142 is used to control and/or configure the first traffic controller 104 and the second traffic controller 108.

In the illustrated example, the sensors 112, 114, 118, 120 and the display outputs 130, 134, 138, 140 are mounted to the ceiling and/or are suspended. In the illustrated example, the sensors 110, 116 and the display outputs 132, 136 are mounted to the floor and/or are at eye level. However, any of the sensors 110, 112, 114, 116, 118, 120 and/or the display outputs 130, 132, 134, 136, 138, 140 may be mounted in any position to enable bodies (e.g., pedestrians, vehicles, etc.) to be detected and for data (e.g., warnings, etc.) to be displayed to the bodies and/or others (e.g., pedestrians, vehicles, etc.).

In some examples in which the display outputs 134, 136, 138, 140 are configured by the configurer 142 to be responsive to the first sensor 112 and/or the second sensor 110, upon detecting a vehicle 144 approaching the first traffic controller 104 from the West 122 and no other traffic approaching the first traffic controller 104 from the other directions 124, 126, 128, the first traffic controller 104 and/or a processor 146 of the configurer 142 cause the display outputs 134, 136, 138, 140 to output a first signal toward the South 124, the East 126 and the North 128 and for no signal to be displayed toward the West 122. In some examples, the first signal is indicative of caution and/or yield and is a triangle having a first color (e.g., orange or amber).

In some examples, one or more of the display outputs 130, 132, 134, 136, 138, 140 may be configured by the configurer 142 to not be responsive to the first sensor 110, the second sensor 112 and/or any of the other sensors 114, 116, 118, 120. In such examples, upon detecting the vehicle 144 approaching the first traffic controller 104 from the West 122 and no other traffic approaching the first traffic controller 104 from the other directions 124, 126, 128, the first traffic controller 104 and/or the processor 146 do not cause the non-responsive ones of the display outputs 130, 132, 134, 136, 138, 140 to output, for example, the first signal and/or any other signal.

In some examples in which the display outputs 134, 136, 138, 140 are configured by the configurer 142 to be responsive to the first sensor 112 and/or the second sensor 110 and the display outputs 130, 132, 134, 136, 138 are configured by the configurer 142 to be responsive to the sixth sensor 120, upon detecting the vehicle 144 approaching the first traffic controller 104 from the West 122, a pedestrian approaching the first traffic controller 104 from the North 128 and no other traffic approaching the first traffic controller 104 from the other directions 124, 126, the first traffic controller 104 and/or the processor 146 cause the display outputs 130, 132, 140 to output a second signal toward the West 122 and the North 128 and cause the display outputs 134, 136, 138 to output the first signal toward the South 124 and the East 126. In some examples, the second signal is an indication of danger and/or a hazard and is an octagon having a second color (e.g., red).

In the illustrated example, to detect approaching traffic, the second traffic controller 108 includes a first sensor 148, a second sensor 149, a third sensor 150, a fourth sensor 151 and a fifth sensor 152 facing respective directions 153, 154, 156, 158. While two sensors are illustrated facing the South 156 and one sensor is illustrated facing the West 154, the East 158 and the North 153, any number of sensors (e.g., 1, 2, 3, 4, etc.) may be provided to detect oncoming traffic in any direction. In the illustrated example, to provide notice and/or warning in response to approaching traffic, the second traffic controller 108 includes a first display output 160, a second display output 162, a third display output 164, a fourth display output 166 and a fifth display output 168 facing the respective directions 153, 154, 156, 158. While two display outputs are illustrated facing the South 156 and one display output is illustrated facing the North 153, the West 154 and the East 158, any number of display outputs (e.g., 1, 2, 3, 4, etc.) may be provided in any direction to provide notice of oncoming traffic and/or to display any other data.

In some examples, the configurer 142 configures the first traffic controller 104 to be communicatively coupled to the second traffic controller 108 such that one or more of the display outputs 160, 162, 164, 166, 168 of the second traffic controller 108 are responsive to one or more of the sensors 110, 112, 114, 116, 118, 120 of the first traffic controller 104 and one more of the display outputs 130, 132, 134, 136, 138, 140 of the first traffic controller 104 are responsive to one or more of the sensors 148, 149, 150, 151, 152 of the second traffic controller 108.

In some examples in which the display outputs 130, 132, 134, 136, 138, 140, 160, 162, 164, 166, 168 are configured by the configurer 142 to be responsive to the sensors 110, 112, 114, 116, 118, 120, 148, 149, 150, 151, 152, upon detecting the vehicle 144 approaching the first traffic controller 104 from the West 122 and no other traffic approaching from the other directions 124, 126, 128, 153, 154, 156, 158, the first traffic controller 104, the second traffic controller 108 and/or the processor 146 cause the display outputs 134, 136, 138, 140, 160, 162, 164, 166, 168 to output the first signal toward the respective directions 124, 126, 128, 153, 154, 156, 158. In some examples, one or more of the display outputs 130, 132, 134, 136, 138, 140, 160, 162, 164, 166, 168 may be configured and/or defined by the configurer 142 not to be responsive to one or more of the sensors 10, 112, 114, 116, 118, 120, 148, 149, 150, 151, 152.

In some examples in which the display outputs 130, 132, 134, 136, 138, 140, 160, 162, 164, 166, 168 are configured by the configurer 142 to be responsive to the sensors 110, 112, 114, 116, 118, 120, 148, 149, 150, 151, 152, upon detecting the vehicle 144 approaching the first traffic controller 104 from the West 122, pedestrians 170, 172, 174 approaching the second traffic controller 108 from the South 156, the East 158, and the North 153, and no other traffic approaching the traffic controllers 104, 108 from the other directions 124, 126, 128, 154, the first traffic controller 104, the second traffic controller 108 and/or the processor 146 cause the display outputs 134, 136, 140 to output the first signal toward the respective directions 124, 128 and cause the display outputs 130, 132, 138, 160, 162, 164, 166, 168 to output the second signal toward the respective directions 122, 126, 153, 154, 156, 158.

To independently configure the first traffic controller 104, in the illustrated example, input is received at an input 176 of the configurer 142 to enable one or more of the output displays 130, 132, 134, 136, 138, 140 of the first traffic controller 104 to be responsive to inputs from one or more of the sensors 110, 112, 114, 116, 118, 120 and for the output displays 160, 162, 164, 166, 168 of the second traffic controller 108 not to be responsive to inputs from the sensors 110, 112, 114, 116, 118, 120. In some examples, in response to inputs received by the input 176 and/or processes performed by the processor 146, an output 178 of the configurer 142 displays an example simulation illustrating the response of the output displays 130, 132, 134, 136, 138, 140 to inputs received from the sensors 110, 112, 114, 116, 118, 120.

In some examples, the configurer 142 and/or the sensors 110, 112, 114, 116, 118, 120, 148, 149, 150, 151, 152 are configured to differentiate between pedestrians and vehicles to not provide signals (e.g., a first signal, a second signal) when no vehicle traffic is detected. In some such examples, upon detecting only pedestrians approaching the first traffic controller 104 from the respective directions 122, 153, 156, 158, the configure 142 enables no signals to be output from the display outputs 130, 132, 138, 160, 162, 164, 166, 168.

In examples in which the first traffic controller 104 is positioned at a three-way intersection as opposed to a four-way intersection, one or more of the sensors 110, 112, 114, 116, 118, 120 and one or more of the output displays 130, 132, 134, 136, 138, 140 not facing an aisle may be deactivated and/or not activated by the configurer 142. In other words, the example traffic controllers disclosed herein can be dynamically configured to be implemented in different types of intersections (e.g., four-way intersection, three-way intersection, etc.) and/or be dynamically configured to cause output displays to respond (e.g., display data and/or signals) and/or not respond to sensor input(s) received.

To independently configure the second traffic controller 108, in the illustrated example, input is received at the input 176 to enable one or more of the output displays 160, 162, 164, 166, 168 of the second traffic controller 108 to be responsive to inputs from one or more of the sensors 148, 149, 150, 151, 152 and for the output displays 130, 132, 134, 136, 138, 140 of the first traffic controller 104 not to be responsive to inputs from the sensors 148, 149, 150, 151, 152. In some examples, in response to inputs received by the input 176 and/or processes performed by the processor 146, the output 178 of the configurer 142 displays an example simulation illustrating the response of the output displays 160, 162, 164, 166, 168 to inputs received from the sensors 148, 149, 150, 151, 152. For example, if an example simulation input is representative of the vehicle 144 approaching the first sensor 112 and the sixth display 140 is response to the first sensor 112, the output 178 of the configurer 142 may provide a visual representation of the sixth display 140

To configure the first traffic controller 104 and the second traffic controller 108 to be communicatively coupled and/or to be networked, in the illustrated example, input is received at the input 176 to enable one or more of the output displays 130, 132, 134, 136, 138, 140, 160, 162, 164, 166, 168 to be responsive to one or more of the sensors 110, 112, 114, 116, 118, 120, 148, 149, 150, 151, 152. In some examples, in response to inputs received by the input 176 and/or processes performed by the processor 146, the output 178 of the configurer 142 displays an example simulation illustrating the response of the output displays 130, 132, 134, 136, 138, 140, 160, 162, 164, 166, 168 to inputs received from the sensors 10, 112, 114, 116, 118, 120, 148, 149, 150, 151, 152.

While an example manner of implementing the configurer 142 is illustrated in FIG. 1, one or more of the elements, processes and/or devices illustrated in FIG. 1 may be combined, divided, re-arranged, omitted, eliminated and/or implemented in any other way. Further, the example input 176, the example output 178, the example processor 146, the example database 143 and/or, more generally, the example configurer 142 of FIG. 1 may be implemented by hardware, software, firmware and/or any combination of hardware, software and/or firmware. Thus, for example, any of the example input 176, the example output 178, the example processor 146, the example database 143 and/or, more generally, the example configurer 142 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example input 176, the example output 178, the example processor 146, the example database 143 and/or, more generally, the example configurer 142 is/are hereby expressly defined to include a tangible computer readable storage device or storage disk such as a memory, a digital versatile disk (DVD), a compact disk (CD), a Blu-ray disk, etc. storing the software and/or firmware. Further still, the example configurer 142 of FIG. 1 may include one or more elements, processes and/or devices in addition to, or instead of, those illustrated in FIG. 1, and/or may include more than one of any or all of the illustrated elements, processes and devices.

Figure 2:
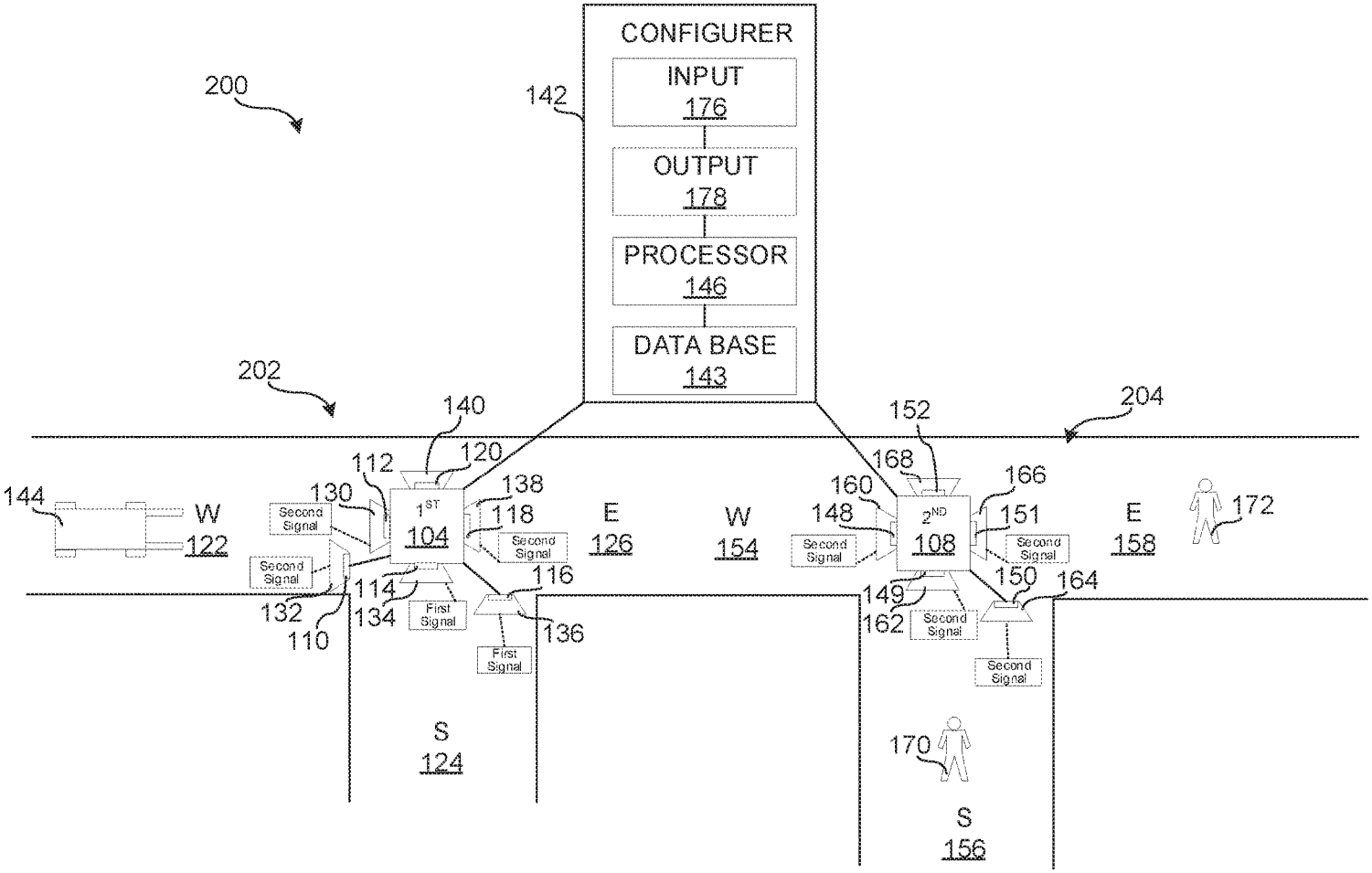
FIG. 2 illustrates another example floor plan including the example first and second traffic controllers of FIG. 1.

FIG. 2 illustrates an example floor plan 200 including a first intersection 202 at which the example first traffic controller 104 is positioned and a second intersection 204 at which the example second traffic controller 108 is positioned. In contrast to the intersections 102, 106 of FIG. 1 that are four-way intersections, the intersections 202, 204 of FIG. 2 are three-way intersections. Thus, in the example of FIG. 2, the configurer 142 does not activate and/or disables the sensors 120, 152 and/or the display outputs 140, 168 not facing an aisle. In the illustrated example, the first and second traffic controllers 104, 108 are communicatively coupled to enable the display outputs 130, 132, 134, 136, 138, 160, 162, 164, 166 to be responsive to the sensors 110, 112, 114, 116, 118, 148, 149, 150, 151.

Figure 3:
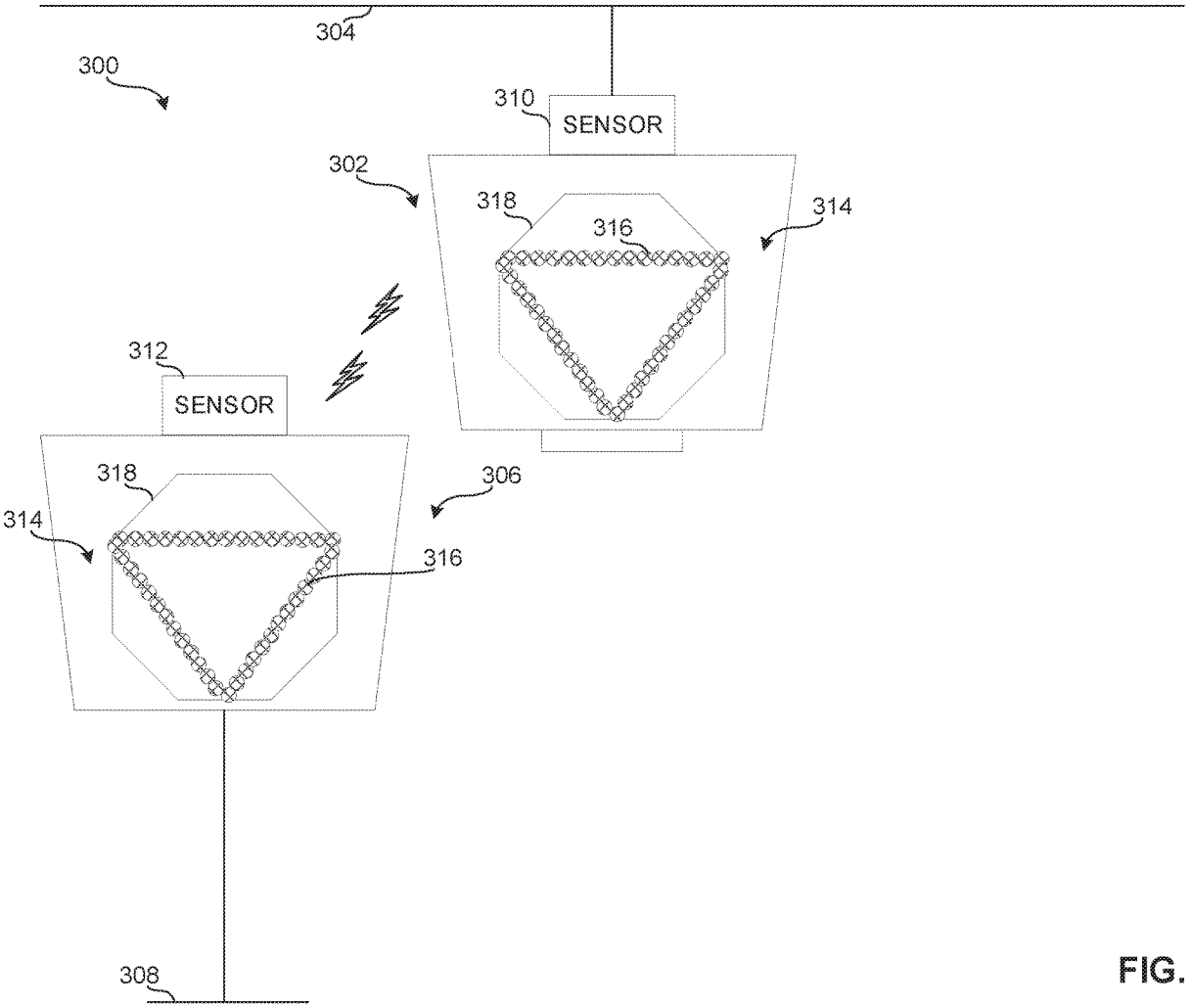
FIG. 3 illustrates example traffic controllers providing first signals.

FIG. 3 illustrates an example traffic controller 300 including an example first traffic controller 302 mounted to a ceiling 304 and an example second traffic controller 306 mounted to a floor 308 where both the first and second traffic controllers 302, 306 are communicatively coupled and are displaying the first signal and/or a yield signal. In the illustrated example, the first and second traffic controllers 302, 306 include first and second sensors 310, 312 and example displays 314 including a first signal 316 illustrated as a triangle contained and/or positioned within a second signal 318 illustrated as an octagon. The first signal 316 may be defined by lights (e.g., LEDs) and the second signal 318 may be defined by lights.

In some examples, the first and second sensors 310, 312 face the same direction and the first sensor 310 monitors a first area and/or zone to identify vehicles and/or pedestrians approaching the traffic controller 300 and the second sensor 312 monitors a second area and/or zone to identify vehicles and/or pedestrians approaching the traffic controller 300. In some examples, the first and second areas and/or zones overlap. In some examples, the first and second areas and/or zones do not overlap. In the illustrated example, the first signal 316 is represented as a triangle and is shown being displayed and/or illuminated and the second signal 318 is represented by an octagon and is shown as not being displayed and/or illuminated.

Figure 4:
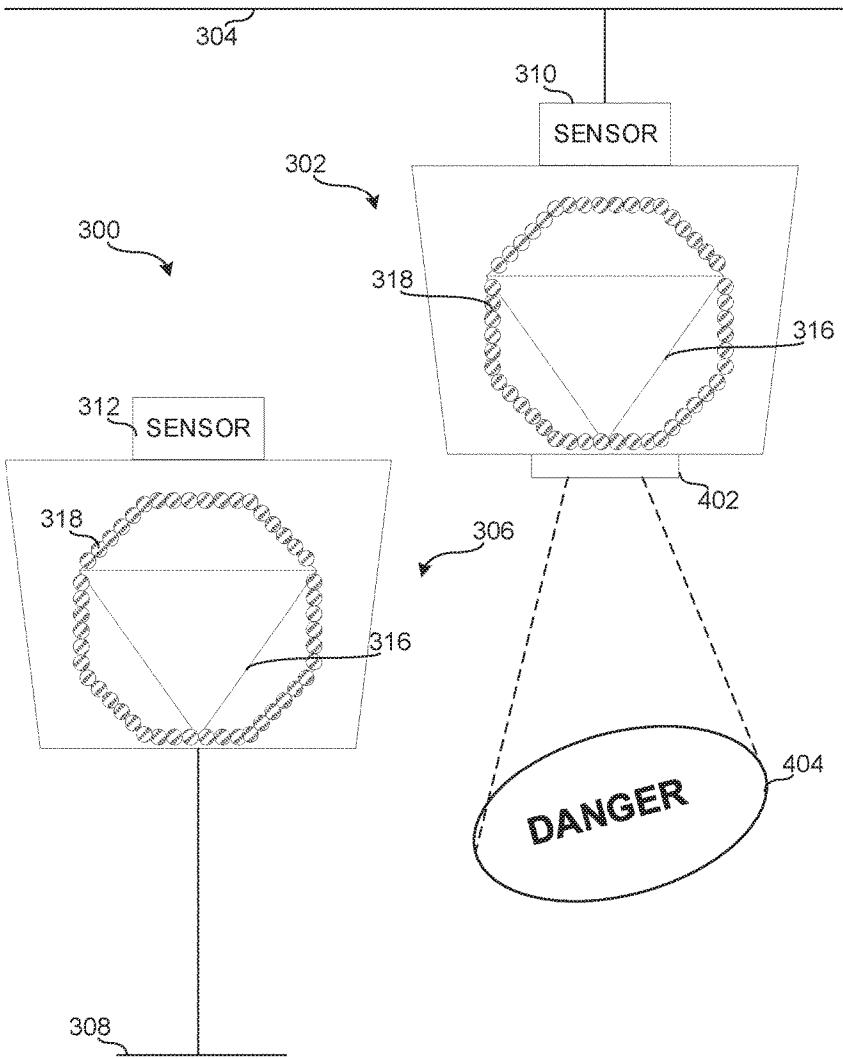
FIG. 4 illustrates the traffic controllers of FIG. 3 providing second signals.

FIG. 4 illustrates the example traffic controller 300 including the first traffic controller 302 mounted to the ceiling 304 and the second traffic controller 306 mounted to the floor 308 where both the first and second traffic controllers 302, 306 are displaying the second signal and/or a danger signal. In this example, the second signal represents a greater warning level than the first signal to garner greater attention to a potential collision hazard. In the illustrated example, the second signal 318 is represented by an octagon and is shown as being displayed and/or illuminated and the first signal 316 is represented as a triangle is shown as not being displayed and/or illuminated. In addition to the display 314, the example first traffic controller 302 includes a projector 402 that projects a projection 404 onto the floor 308 when the second signal 318 is being displayed. In some examples, the projection 404 may include an illuminated shape, an illuminated symbol, a solid signal, a flashing signal, a combination of a solid signal and a flashing signal, a pictographic warning symbol, etc.

Figure 5:
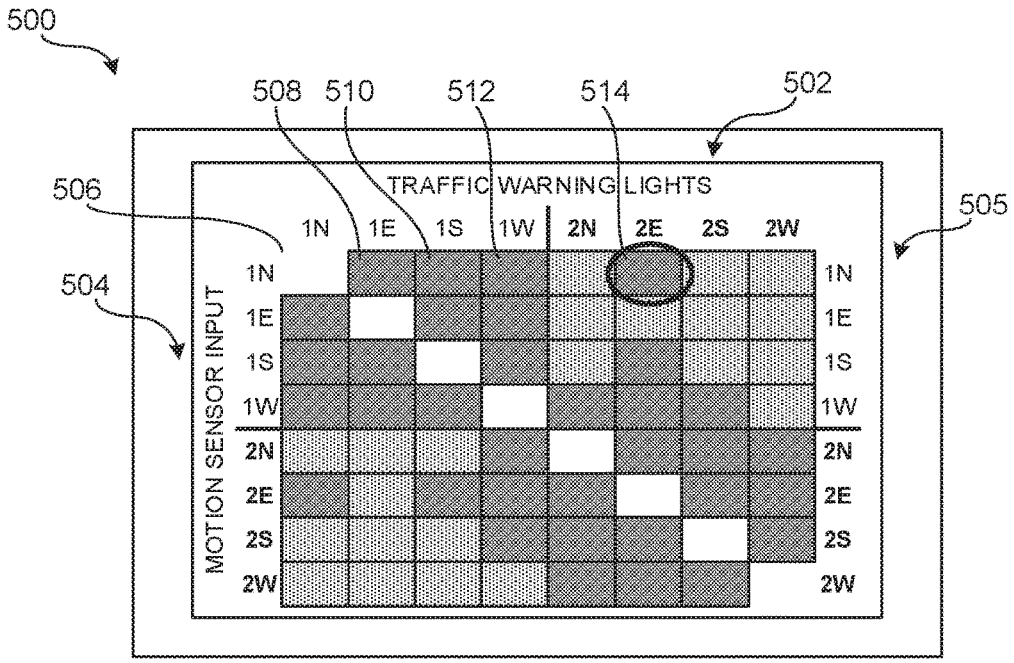
FIGS. 5-12 illustrate example user interfaces that can be used to implement and/or configure the example traffic controllers disclosed herein.

FIG. 5 illustrates an example user interface 500 that can be used in connection with the example configurer 142 of FIG. 1 to designate the relationships between different display outputs 502 and different sensor inputs 504. In the illustrated example, a truth table 505 illustrates designated relationships between a sensor input corresponding to a 1N sensor 506 and a 1E display 508, a 1S display 510, a 1W display 512 and a 2E display 514. In some examples, the acronym 1E corresponds to the East facing display of the first traffic controller 104, the acronym 1S corresponds to the South facing display of the first traffic controller 104, the acronym 1W corresponds to the West facing display of the first traffic controller 104 and the acronym 2E corresponds to the East facing display of the second traffic controller 108. In some examples, based on input received from a user, a relationship between one of the output displays and one of the sensors may be toggled between an active relationship in which an input from the sensor causes corresponding data and/or a message to be shown at the output display or an inactive relationship in which an input from the sensor does not cause corresponding data and/or a message to be shown at the output display.

Figure 6:
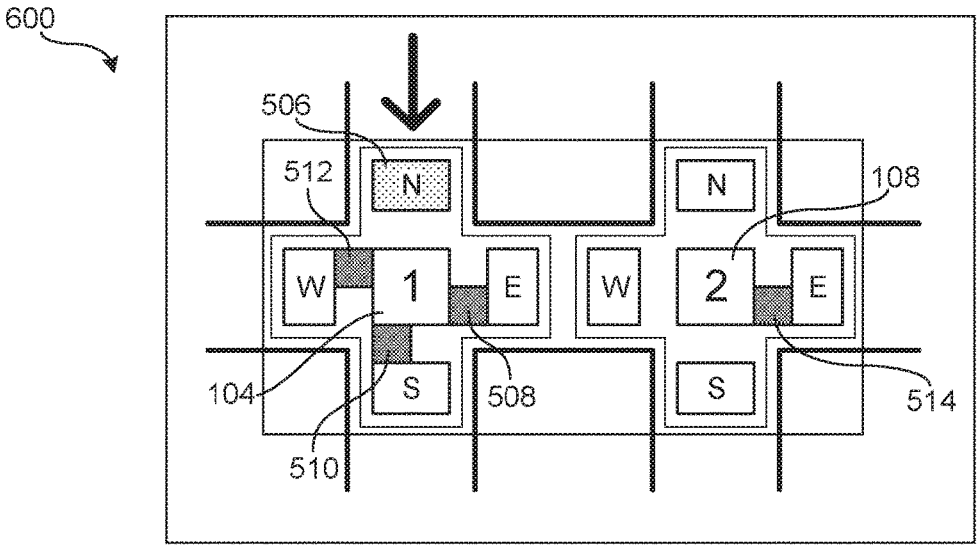

FIG. 6 illustrates an example user interface 600 including a vehicle and/or pedestrian input at the 1N sensor 506. In illustrated example, based on the relationships between the 1N sensor 506 and the displays 508, 510, 512, 514, the sensor inputs from the 1N sensor 506 cause a first signal and/or a yield signal to be displayed at the 1E display 508, the 1S display 510, the 1W display 512 and the 2E display 514. In the example of FIG. 6, other than the vehicle and/or pedestrian detected by the 1N sensor 506, no other vehicles and/or pedestrians are identified approaching the first traffic controller 104 or the second traffic controller 108.

Figure 7:
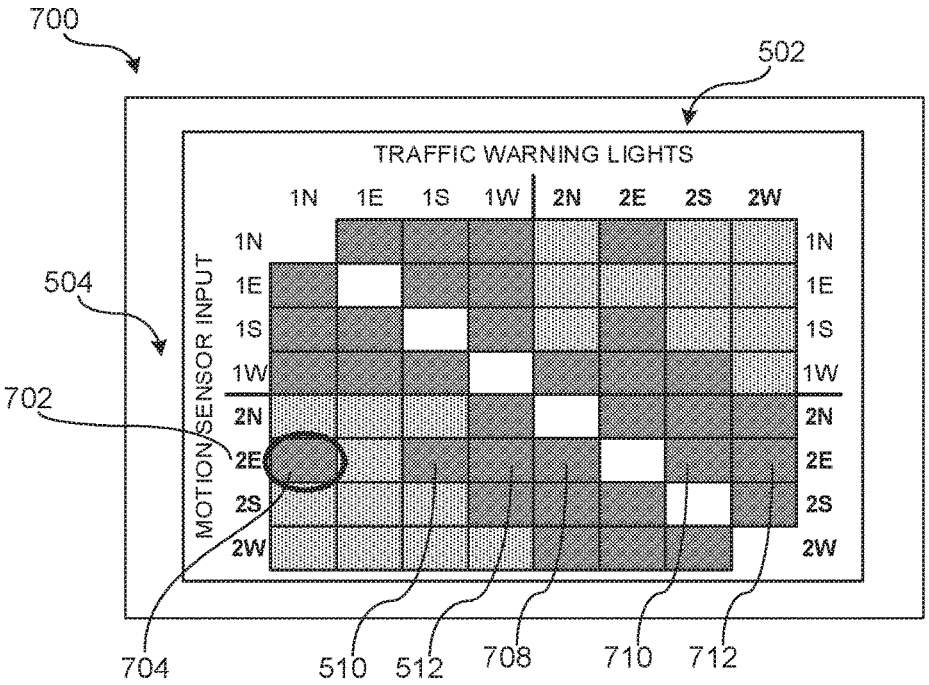

FIG. 7 illustrates an example user interface 500 that can be used in connection with the example configurer 142 of FIG. 1 to designate the relationships between the different display outputs 502 and the different sensor inputs 504. In the illustrated example, a relationship is shown as being designated between a sensor input corresponding to a 2E sensor 702 and a 1N display 704, the 1S display 510, the 1W display 512, a 2N display 708, a 2S display 710 and a 2W display 712.

Figure 8:
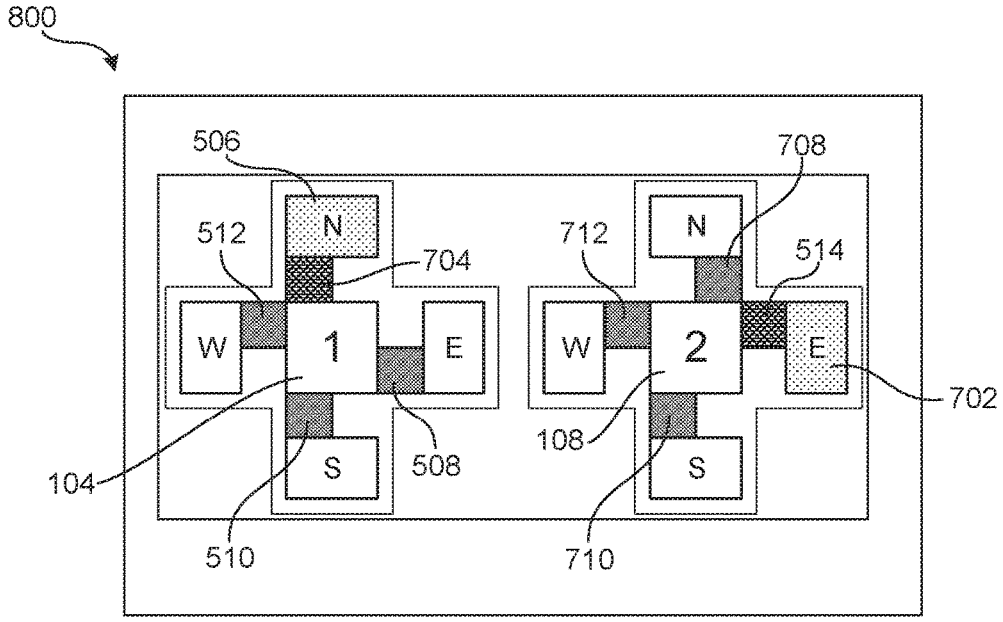

FIG. 8 illustrates an example user interface 800 including a vehicle and/or pedestrian input at the 1N sensor 506 and a vehicle and/or pedestrian input at the 2E sensor 702. In the illustrated example, based on the relationships between the 1N sensor 506, the 2E sensor 702 and the displays 508, 510, 512, 514, 704, 710, 714, the sensor inputs from the 1N sensor 506 and the 2E sensor 702 cause a first signal and/or a yield signal to be displayed at the 1E display 508, the 1S display 510, the 1W display 512, the 2N display 708, the 2S display 710 and the 2W display 712 and a second signal and/or a danger signal to be displayed at the 1N display 704 and the 2E display 514.

Figure 9:
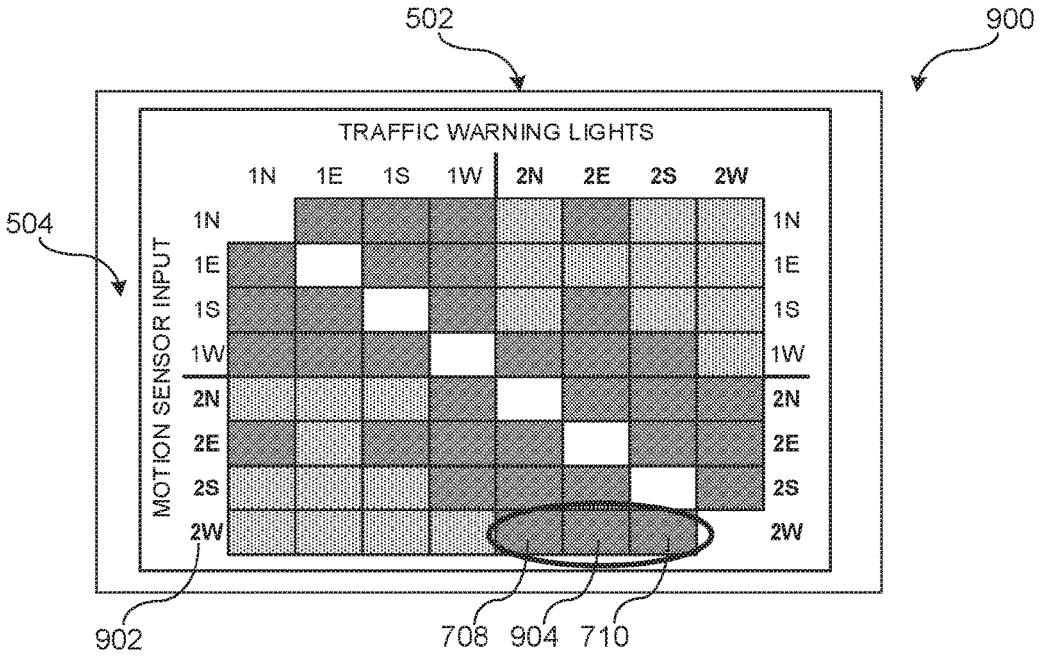

FIG. 9 illustrates an example user interface 900 that can be used in connection with the example configurer 142 of FIG. 1 to designate the relationships between the different display outputs 502 and the different sensor inputs 504. In the illustrated example, a relationship is shown as being designated between a sensor input corresponding to a 2W sensor 902 and the 2N display 708, a 2E display 904 and the 2S display 710.

Figure 10:
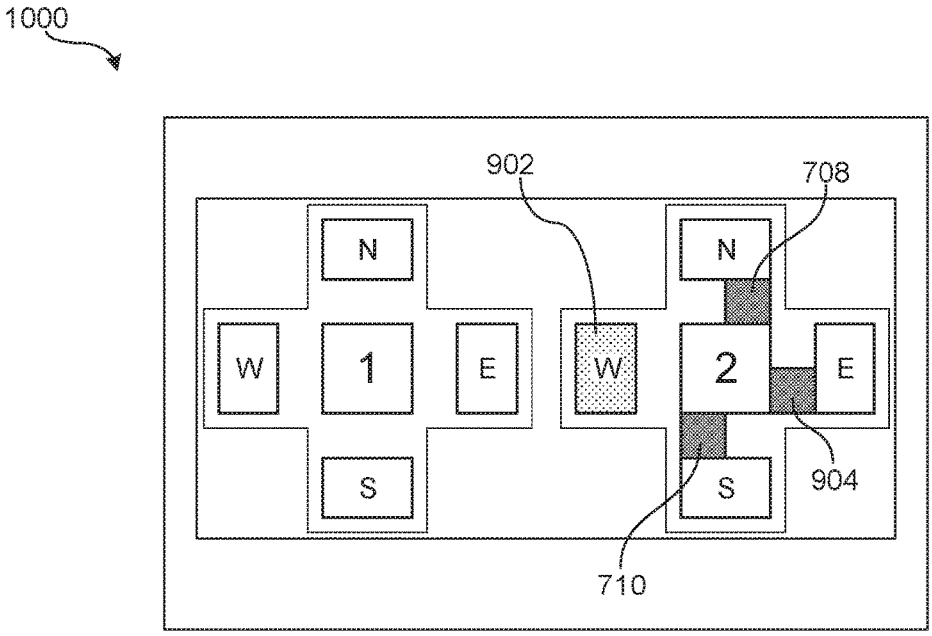

FIG. 10 illustrates an example user interface 1000 including a vehicle and/or pedestrian input at the 2W sensor 902. In the illustrated example, based on the relationships between the 2W sensor 902 and the displays 708, 710 and 904, the sensor inputs from the 2W sensor 902 cause a first signal and/or a yield signal to be displayed at the 2N display 708, the 2E display 904 and the 2S display 710.

Figure 11:
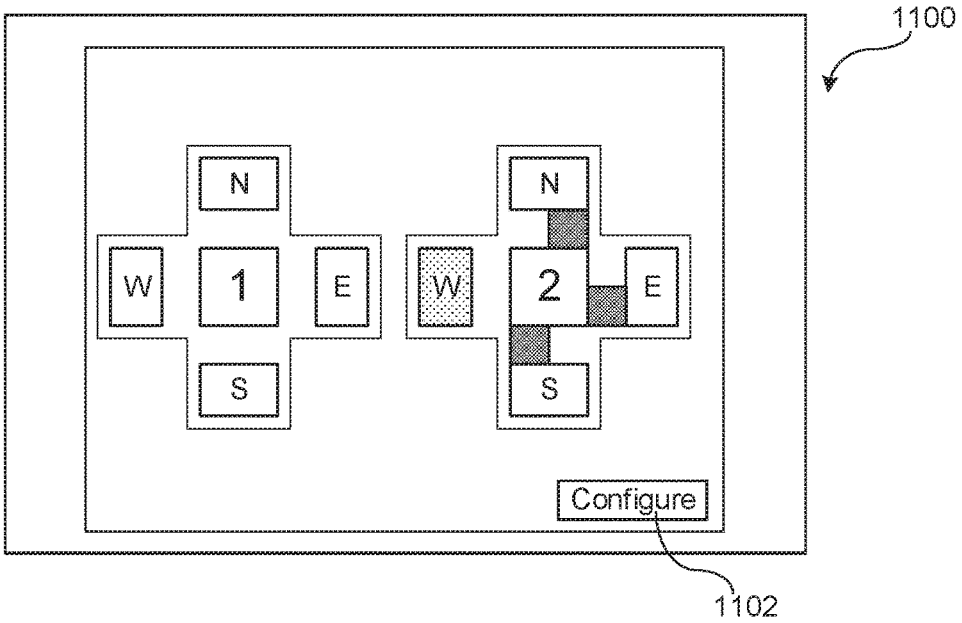

FIG. 11 illustrates an example user interface 1100 that can be used in connection with the example configurer 142 of FIG. 1. In the illustrated example, a configure button 1102 is displayed for user selection to enable the relationships designated between the display outputs and the sensor inputs to be set and/or defined.

Figure 12:
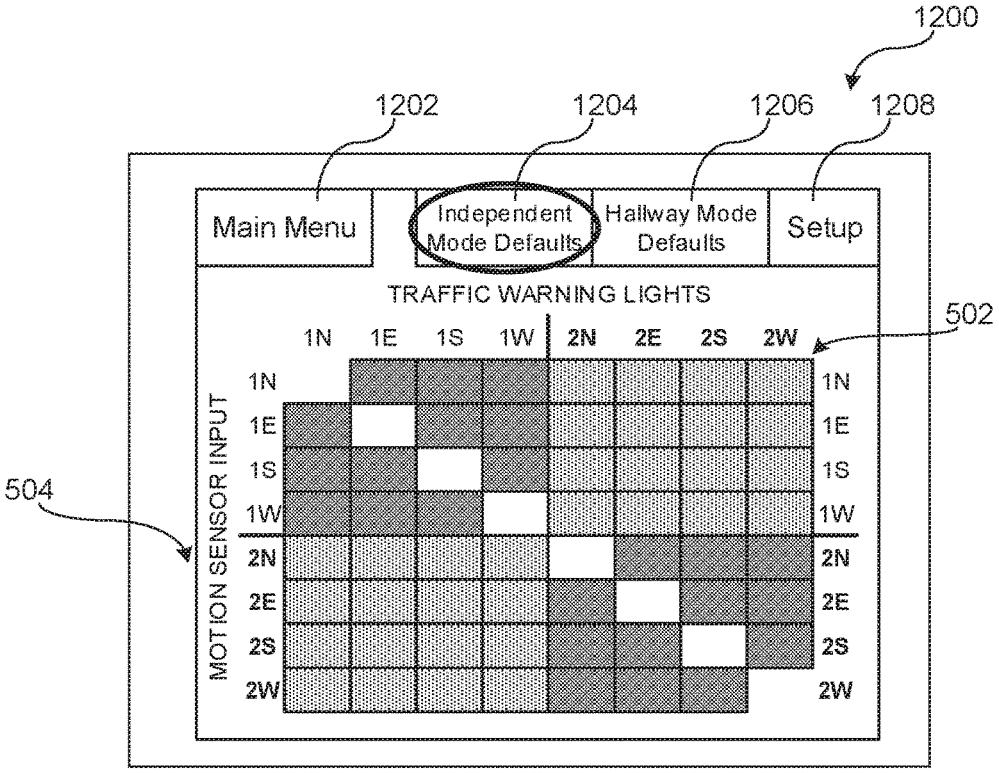

FIG. 12 illustrates an example user interface 1200 that can be used in connection with the example configurer 142 of FIG. 1 to designate the relationships between the different display outputs 502 and the different sensor inputs 504. In the illustrated example, the user interface 1200 includes a main menu button 1202, an independent mode default button 1204, a hallway mode default button 1206 and a set up button 1208.

In this example, the independent mode default button 1204 provides default settings in which the first traffic controller 104 independently operates without being influenced by the second traffic controller 108 and in which the second traffic controller 108 independently operates without being influenced by the first traffic controller 108. In other words, in the independent mode, sensors of one of the traffic controllers may only influence the displays of the traffic controller to which the sensors are coupled (e.g., physically coupled, communicatively coupled).

In some examples, the hallway mode default button 1206 provides default settings in which the first traffic controller 104 is communicatively coupled to the second traffic controller 104 such that the first traffic controller 104 is influenced by the second traffic controller 108 and the second traffic controller 108 is influenced by the first traffic controller 104. In other words, in the hallway mode, sensors of the traffic controllers influence the displays of other traffic controllers.

FIG. 13 illustrates an example table 1300 including inputs from the various sensors and outputs of the various displays of, for example, the first and/or second traffic controllers 104, 108.

Figure 14:
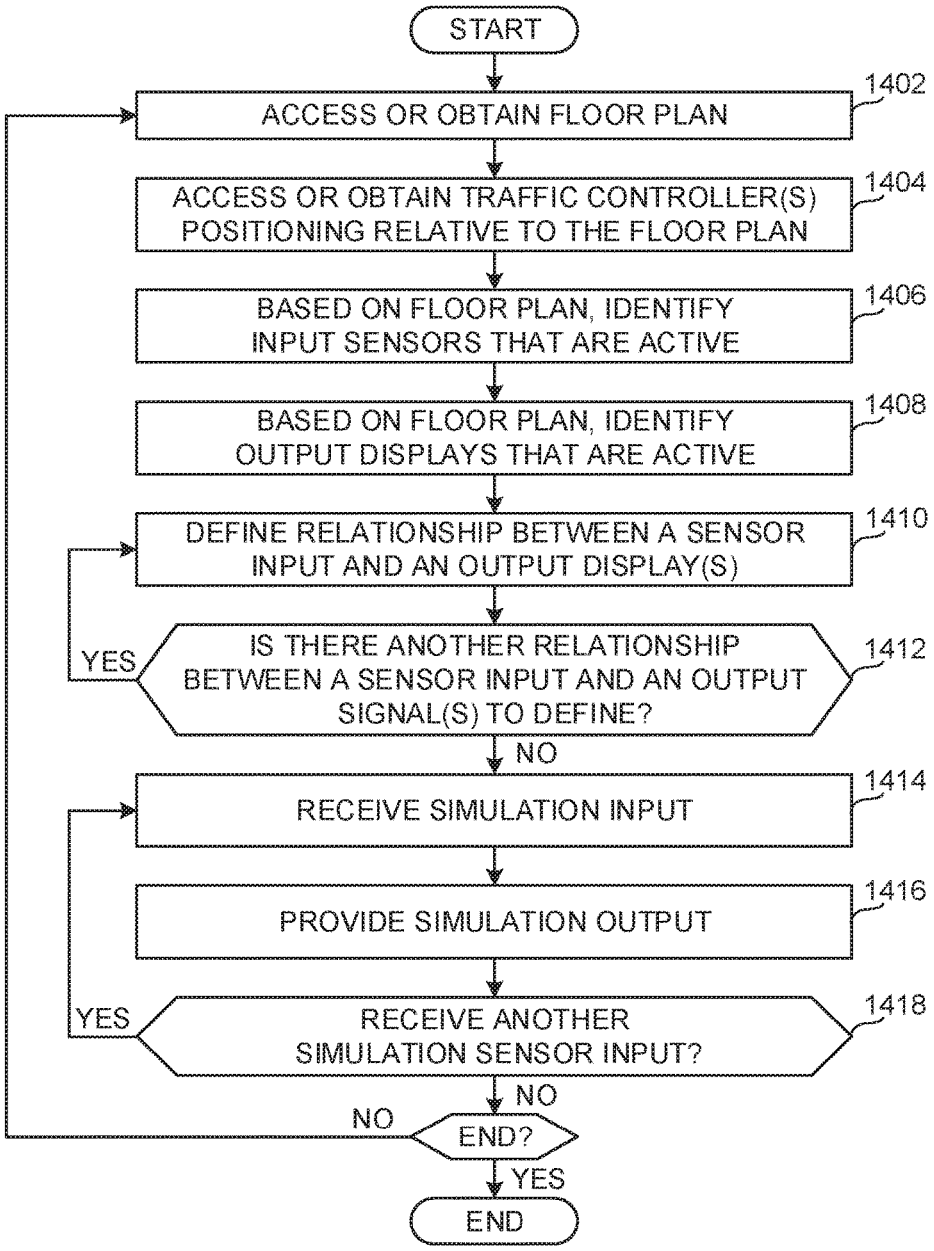
FIG. 14 is an example flowchart representative of machine readable instructions that may be executed to implement the example traffic controllers disclosed herein.

A flowchart representative of example machine readable instructions for implementing the first traffic controller 104, the second traffic controller 108, the input 176, the output 178, the processor 146, the database 143 and/or the configurer 142 of FIG. 1 is shown in FIG. 14. In this example, the machine readable instructions comprise a program for execution by a processor such as the processor 1512 shown in the example processor platform 1500 discussed below in connection with FIG. 15. The program may be embodied in software stored on a tangible computer readable storage medium such as a CD-ROM, a floppy disk, a hard drive, a digital versatile disk (DVD), a Blu-ray disk, or a memory associated with the processor 1512, but the entire program and/or parts thereof could alternatively be executed by a device other than the processor 1512 and/or embodied in firmware or dedicated hardware. Further, although the example program is described with reference to the flowchart illustrated in FIG. 14, many other methods of implementing the first traffic controller 104, the second traffic controller 108, the input 176, the output 178, the processor 146, the database 143 and/or the configurer 142 of FIG. 1 may alternatively be used. For example, the order of execution of the blocks may be changed, and/or some of the blocks described may be changed, eliminated, or combined.

As mentioned above, the example processes of FIG. 14 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and transmission media. As used herein, "tangible computer readable storage medium" and "tangible machine readable storage medium" are used interchangeably. Additionally or alternatively, the example processes of FIG. 14 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and transmission media. As used herein, when the phrase "at least" is used as the transition term in a preamble of a claim, it is open-ended in the same manner as the term "comprising" is open ended.

The program of FIG. 14 begins at block 1402 by a floor plan being accessed and/or obtained (block 1402) by, for example, a user accessing and/or obtaining a default floor plan 100, 200 using the configurer 142 and/or one or more of the user interfaces 500, 600, 700, 800, 900, 1000, 1100, 1200, the user accessing and/or obtaining a floor plan 100, 200 using the configurer 142 and/or one or more of the user interfaces 500, 600, 700, 800, 900, 1000, 1100, 1200 and/or the user providing input using the configurer 142 and/or one or more of the user interfaces 500, 600, 700, 800, 900, 1000, 1100, 1200 on the floor plan 100, 200. The program accesses or obtains the positioning of a traffic controller(s) relative to the floor plan (block 1404) by, for example, a user identifying a location of the traffic controllers 104, 108 on the floor plan 100, 200 using the configurer 142 and/or one or more of the user interfaces 500, 600, 700, 800, 900, 1000, 1100, 1200.

The program identifies input sensors that are active (block 1406) by, for example, a user using the configurer 142 and/or one or more of the user interfaces 500, 600, 700, 800, 900, 1000, 1100, 1200 to identify which of the sensors 110, 112, 114, 116, 118, 120, 148, 149, 150, 151, 152 are to be used based on the type of intersection (e.g., four-way intersection, a three-way intersection) in which the traffic controller 104, 108 is implemented.

The program identifies output displays that are active (block 1408) by, for example, a user using the configurer 142 and/or one or more of the user interfaces 500, 600, 700, 800, 900, 1000, 1100, 1200 to identify which of the display outputs 130, 132, 134, 136, 138, 140, 160, 162, 164, 166, 168 are to be used based on the type of intersection (e.g., four-way intersection, a three-way intersection) in which the traffic controller 104, 108 is implemented.

A relationship between a sensor input and an output display is defined (block 1410) by, for example, a user using the configurer 142 and/or one or more of the user interfaces 500, 600, 700, 800, 900, 1000, 1100, 1200 to identify a relationship between one or more of the display outputs 130, 132, 134, 136, 138, 140, 160, 162, 164, 166, 168 and one or more of the sensors 110, 112, 114, 116, 118, 120, 148, 149, 150, 151, 152. In some examples, the configurer 142 and/or the sensors 110, 112, 114, 116, 118, 120, 148, 149, 150, 151, 152 are receive inputs to differentiate between pedestrians and vehicles. In some examples, such inputs enable no signals to be provided when pedestrian traffic is identified and no vehicle traffic is identified.

The program determines if there is another relationship between a sensor input and an output display is to be defined (block 1412).

A simulation input is received (block 1414) by, for example, a user using the configurer 142 and/or one or more of the user interfaces 500, 600, 700, 800, 900, 1000, 1100, 1200 to simulate one of the sensors 110, 112, 114, 116, 118, 120, 148, 149, 150, 151, 152 detecting a vehicle and/or a pedestrian. A simulation output is provided (block 1416) by, for example, displaying a response to an input(s) received from one or more or the sensors 110, 112, 114, 116, 118, 120, 148, 149, 150, 151, 152 using the configurer 142 and/or one or more of the user interfaces 500, 600, 700, 800, 900, 1000, 1100, 1200. The program determines if another simulation sensor input is to be received (block 1418).

Figure 15:
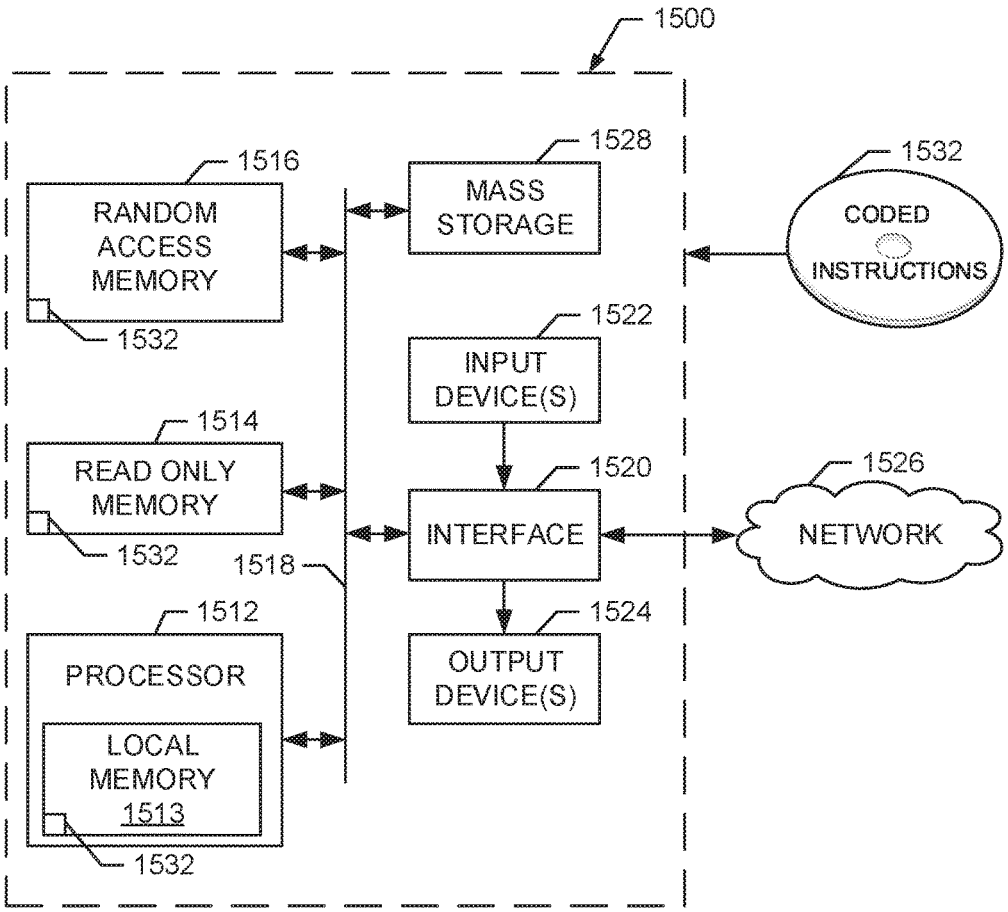
FIG. 15 illustrates an example processor platform to execute the instructions of FIG. 14 to implement the example traffic controllers disclosed herein.

FIG. 15 is a block diagram of an example processor platform 1500 capable of executing the instructions of FIG. 14 to implement the first traffic controller 104, the second traffic controller 108, the input 176, the output 178, the processor 146 and the database 143 and/or the configurer 142 of FIG. 1. The processor platform 1500 can be, for example, a server, a personal computer, a mobile device (e.g., a cell phone, a smart phone, a tablet such as an iPad™), a personal digital assistant (PDA), an Internet appliance, or any other type of computing device.

The processor platform 1500 of the illustrated example includes a processor 1512. The processor 1012 of the illustrated example is hardware. For example, the processor 1512 can be implemented by one or more integrated circuits, logic circuits, microprocessors or controllers from any desired family or manufacturer.

The processor 1512 of the illustrated example includes a local memory 1513 (e.g., a cache). The processor 1512 of the illustrated example is in communication with a main memory including a volatile memory 1514 and a non-volatile memory 1516 via a bus 1518. The volatile memory 1514 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1516 may be implemented by flash memory and/or any other desired type of memory device. Access to the main memory 1514, 1516 is controlled by a memory controller.

The processor platform 1500 of the illustrated example also includes an interface circuit 1520. The interface circuit 1520 may be implemented by any type of interface standard, such as an Ethernet interface, a universal serial bus (USB), and/or a PCI express interface.

In the illustrated example, one or more input devices 1522 are connected to the interface circuit 1520. The input device(s) 1522 permit(s) a user to enter data and commands into the processor 1012. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1524 are also connected to the interface circuit 1520 of the illustrated example. The output devices 1524 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1520 of the illustrated example, thus, typically includes a graphics driver card, a graphics driver chip or a graphics driver processor.

The interface circuit 1520 of the illustrated example also includes a communication device such as a transmitter, a receiver, a transceiver, a modem and/or network interface card to facilitate exchange of data with external machines (e.g., computing devices of any kind) via a network 1526 (e.g., an Ethernet connection, a digital subscriber line (DSL), a telephone line, coaxial cable, a cellular telephone system, etc.). In some examples, the network interface is implemented using an RS-485 serial interface.

The processor platform 1500 of the illustrated example also includes one or more mass storage devices 1528 for storing software and/or data. Examples of such mass storage devices 1528 include floppy disk drives, hard drive disks, compact disk drives, Blu-ray disk drives, RAID systems, and digital versatile disk (DVD) drives.

The coded instructions 1032 of FIG. 14 may be stored in the mass storage device 1528, in the volatile memory 1514, in the non-volatile memory 1516, and/or on a removable tangible computer readable storage medium such as a CD or DVD.

From the foregoing, it will be appreciated that the above disclosed methods, apparatus and articles of manufacture relate to providing different warning levels when there is traffic identified approaching an intersection in one direction and when there is traffic identified approaching the intersection in two directions. In some examples, a heightened warning is provided to the traffic approaching from separate directions and a lesser warning is provided in a direction in which no traffic is detected.

In some examples, by providing an alert in the direction where the traffic (e.g., vehicle traffic, pedestrian traffic) is present, the examples disclosed herein substantially ensure that operators and/or pedestrians are not desensitized to the warnings. The examples disclosed herein provide a warning signal (e.g., a first signal) when traffic is detected from, for example, only one direction and a danger signal when an impending collision is detected. In some examples, the sensors are configured to differentiate between a vehicle (e.g., a fork truck) and a pedestrian to enable warning signals and/or danger signals to be provided when a vehicle is present and not to provide warning signals and/or danger signals when a vehicle is not present but a pedestrian(s) is identified as being present.

In some examples, to provide additional and/or alternative signaling to an operator and/or a pedestrian, a warning(s) may be projected onto the floor or in any other direction. In some examples, the projection may be an illuminated shape, an illuminated symbol, a solid signal, a flashing signal, a combination of a solid signal and a flashing signal, a pictographic warning symbol. In some examples, the projection source (e.g., the traffic controller) may be wall mounted, ceiling mounted and be employed using lights, lasers, etc. In some examples, the example traffic controllers include sensors facing the same direction having different detection zones and different displays facing the same direction where one of the displays is mounted overhead and another of the displays is mounted at eye level to enable additional signals to be provided in a single direction.

In examples where multiple intersections are present, the example traffic controllers may communicate and/or be networked together to enable a first traffic controller to provide input to a second traffic controller. For example, an oncoming vehicle identified approaching a first traffic controller from the North may cause warning signals to be displayed at the South side of first traffic controller, the East side of the first traffic controller, the West side of the first traffic controller and cause the East side of a second traffic controller to also display a warning signal. In other examples, when an oncoming vehicle is identified approaching a first traffic controller from the North and an oncoming vehicle is identified approaching a second traffic controller from the East, a first traffic controller and/or a second traffic controller may cause a danger signal to be displayed at the North side of the first traffic controller and for warning signals to be displayed at the South side of first traffic controller, the East side of the first traffic controller, the West side of the first traffic controller. Additionally, in this example, because the first and second traffic controllers are communicatively coupled, the traffic controller and/or the second traffic controller may cause a danger signal to be displayed at the East side of the second traffic controller and for warning signals to be displayed at the South side of second traffic controller, the North side of the second traffic controller, the West side of the second traffic controller.

In some examples, to enable the examples disclosed herein to be dynamically configurable and for the traffic controllers to be usable with different layouts (e.g., four-way intersections, etc.), input may be received to identify which sensors influence which warning directions. For example, a North sensor input from a first traffic controller may be identified to influence and/or cause a warning and/or danger signal to be displayed at an East warning direction of a second traffic controller. In some examples, after the example traffic controllers are dynamically configured, example simulations may be run to enable a user to verify the configurations.

In examples in which the traffic controllers are used with three-way intersections, the traffic controller may include displays and sensors facing three directions and include a blank on the fourth face. To retrofit and/or convert a three-way traffic controller to a four-way traffic controller, the blank may be removed and a panel including a display and/or a sensor may be coupled to the traffic controller in place of the blank. In some examples, the display and/or the sensor may be coupled to (e.g., plugged into) a printed circuit board (PCB) of the traffic controller to enable communication between the traffic controller, the sensor, the display and/or the configurer.

As set forth herein, an example apparatus includes a first sensor to be directed in a first direction to detect oncoming traffic; a first display to face the first direction; a second sensor to be directed in a second direction to detect oncoming traffic; a second display to face the second direction; and a processor, the processor to define a relationship between the first sensor and the second display, the relationship to cause the second display to display a first signal in response to the first sensor identifying traffic and a second signal in response to the first sensor and the second sensor identifying traffic, the first signal indicative of a first warning level, the second signal indicative of a second warning level greater than the first warning level, in response to traffic being identified by the first sensor and no traffic being identified by the second sensor, the processor to cause the first signal to be displayed by the second display and for no signal to be displayed by the first display.

In some examples, the relationship is a first relationship, further including: a third sensor to be directed in a third direction to detect oncoming traffic; a third display to face the third direction; a fourth sensor to be directed in a fourth direction to detect oncoming traffic; and a fourth display to face the fourth direction, the processor to define a second relationship between the first sensor and the third display, the processor to define a third relationship between the first sensor and the fourth display, the second relationship to cause the third display to display the first signal in response to the first sensor identifying traffic and the second signal in response to the first sensor and the third sensor identifying traffic, the third relationship to cause the fourth display to display the first signal in response to the first sensor identifying traffic and the second signal in response to the first sensor and the fourth sensor identifying traffic.

In some examples, the relationship is a first relationship, the processor is to define a second relationship between the second sensor and first display, the second relationship to cause the first display to display the first signal in response to the second sensor identifying traffic and the second signal in response to the first sensor and the second sensor identifying traffic. In some examples, in response to traffic being identified by the second sensor and no traffic being identified by the first sensor, the processor is to cause the first signal to be displayed by the first display and for no signal to be displayed by the second display. In some examples, in response to the traffic being identified by the first sensor and traffic being identified by the second sensor, the processor is to cause the second signal to be displayed by the first display and the second signal to be displayed by the second display. In some examples, the apparatus includes a housing including the first sensor, the first display, the second sensor, and the second display.

In some examples, the apparatus includes a third sensor to be directed in the first direction to detect oncoming traffic and a third display facing the first direction, the first sensor to monitor a first zone to identify oncoming traffic, the third sensor to monitor a second zone to identify oncoming traffic, the first display to be positioned at a first location and the third display to be positioned at a second location. In some examples, the first sensor, the first display, the second sensor, and the second display are to be disposed at a first intersection, the relationship is a first relationship, further including: a third sensor to be directed in a third direction to detect oncoming traffic; a third display to face the third direction, the third sensor and the third display to be disposed at a second intersection; the processor to define a second relationship between the first sensor and the third display, the second relationship to cause the third display to display the first signal in response to the first sensor identifying traffic and the second signal in response to the first sensor and the third sensor identifying traffic.

In some examples, the apparatus includes an input to enable the relationship between the first sensor and the second display to be dynamically defined. In some examples, the input is associated with a modular device, a mobile device, or a computer. In some examples, the first display defines the first signal and the second signal, lights of the second signal surrounding lights of the first signal. In some examples, the second signal includes different illuminated signals in different directions.

An example apparatus includes a first display facing a first direction; a second display facing a second direction; a third display facing a third direction; and a processor, in response to a first input being received indicative of traffic approaching the first display and no traffic approaching the second display and the third display, the processor to cause the second display and the third display to display a first signal and for the first display not to display the first signal or a second signal, the first signal indicative of a first warning level, the second signal indicative of a second warning level greater than the first warning level, the first signal being illuminatable on the second display, the second signal being illuminatable on the second display, the first signal, when illuminated, being disposed within a perimeter of the second signal, when illuminated.

In some examples, in response to a second input being received indicative of traffic approaching the first display and the second display and no traffic approaching the third display, the processor to cause the first display and the second display to display the second signal and for the third display to display the first signal. In some examples, the apparatus includes a first sensor to be directed in the first direction to detect oncoming traffic, a second sensor to be directed in the second direction to detect oncoming traffic, a third sensor to be directed in the third direction to detect oncoming traffic, the first sensor, the second sensor, and the third sensor to provide input to the processor indicative of traffic approaching the respective ones of the first display, the second display, and the third display.

In some examples, the first signal is a first illuminated shape and the second signal is a second illuminated shape. In some examples, the apparatus includes a housing including the first display, the second display, and the third display. In some examples, the first display, the second display, and the third display are to be disposed at a first intersection, further including a fourth display facing a fourth direction, the fourth display to be disposed at a second intersection, in response to second input being received indicative of traffic approaching the first display and no traffic approaching the fourth display, the processor to cause the fourth display to display the first signal and for the first display not to display the first signal or the second signal.

An example method includes defining a relationship between a first sensor and a second display, the first sensor to be directed in a first direction and the second display to be directed in a second direction, the relationship to enable the second display to: display a first signal in response to a first input indicative of traffic approaching a first display and traffic not approaching the second display; and display a second signal in response to a second input indicative of traffic approaching the first display and traffic approaching the second display, the first signal indicative of a first warning level, the second signal indicative of a second warning level greater than the first warning level; receiving the first input; displaying the first signal from the second display; and not displaying the first signal or the second signal from the first display. In some examples, the method includes receiving the second input and displaying the second signal from the first display and displaying the second signal from the second display.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus, comprising:

a first sensor to face a first direction to detect oncoming traffic in a first area;

a second sensor to face a second direction to detect oncoming traffic in a second area; and a first display to face the first area, the first display to display a first signal in response to (1) the first sensor not detecting the oncoming traffic in the first area and (2) the second sensor detecting the oncoming traffic in the second area, the first display to display a second signal in response to (1) the first sensor detecting the oncoming traffic in the first area and (2) the second sensor detecting the oncoming traffic in the second area, the first signal being different than the second signal.

2. The apparatus as defined in claim 1, wherein the first signal is indicative of a first warning level, and the second signal is indicative of a second warning level greater than the first warning level.

3. The apparatus as defined in claim 1, further including a second display to face the second area.

4. The apparatus as defined in claim 3, wherein the second display to display the first signal in response to (1) the first sensor detecting the oncoming traffic in the first area and (2) the second sensor not detecting the oncoming traffic in the second area, the second display to display the second signal in response to (1) the first sensor detecting the oncoming traffic in the first area and (2) the second sensor detecting the oncoming traffic in the second area.

5. The apparatus as defined in claim 3, wherein the first and second displays display no signal when (1) the first sensor does not detect the oncoming traffic in the first area and (2) the second sensor does not detect the oncoming traffic in the second area.

6. The apparatus as defined in claim 3, further including a housing, the housing including the first sensor and the first display, at least one of the second sensor or the second display to be spaced apart from the housing.

7. The apparatus as defined in claim 3, further including:

a housing including the first sensor, the second sensor, the first display, and the second display; and a third sensor to detect the oncoming traffic in the first area, the third sensor to be spaced apart from the housing, the first sensor to detect the oncoming traffic in a first zone of the first area, and the third sensor to detect the oncoming traffic in a second zone of the first area different than the first zone.

8. The apparatus as defined in claim 7, wherein the second display is to display the first signal in response to (1) at least one of the first or third sensors detecting the oncoming traffic in the first area and (2) the second sensor not detecting the oncoming traffic in the second area, the second display to display the second signal in response to (1) at least one of the first or third sensors detecting the oncoming traffic in the first area and (2) the second sensor detecting the oncoming traffic in the second area.

9. The apparatus as defined in claim 7, wherein the first and second zones overlap.

10. The apparatus as defined in claim 7, wherein the first and second zones do not overlap.

11. The apparatus as defined in claim 3, further including:

a housing including the first sensor, the second sensor, the first display, and the second display; and a third display to face the first area, the third display to be spaced apart from the housing, the third display to display a same signal as displayed by the first display.

12. The apparatus as defined in claim 1, further including a projector to project light toward a floor in response to (1) the first sensor detecting the oncoming traffic in the first area and (2) the second sensor detecting the oncoming traffic in the second area, the light to be visible from the first and second areas.

13. A non-transitory computer readable medium comprising instructions that, when executed, cause a machine to at least:

detect oncoming traffic in a first area based on a first input from a first sensor facing in a first direction;

detect oncoming traffic in a second area based on a second input from a second sensor facing in a second direction; and display, via a first display facing toward the first area, a first signal in response to (1) receiving no input from the first sensor and (2) receiving the second input from the second sensor; and display, via the first display, a second signal in response to (1) receiving the first input from the first sensor and (2) receiving the second input from the second sensor, the first signal being different than the second signal.

14. The non-transitory computer readable medium as defined in claim 13, wherein the instructions further cause the machine to:

display, via a second display facing toward the second area, the first signal in response to (1) receiving the first input from the first sensor and (2) receiving no input from the second sensor; and display, via the second display, the second signal in response to (1) receiving the first input from the first sensor and (2) receiving the second input from the second sensor.

15. The non-transitory computer readable medium as defined in claim 14, wherein the instructions further cause the machine to:

display, via the second display, the first signal in response to (1) receiving at least one of the first input from the first sensor or a third input from a third sensor and (2) receiving no input from the second sensor, the first input from the first sensor indicative of the oncoming traffic of the first area associated with a first zone, the third input from the third sensor indicative of the oncoming traffic in the first area associated with a second zone different than the first zone, the third sensor to be spaced apart from the first sensor; and display, via the second display, the second signal in response to (1) receiving at least one of the first input from the first sensor or the third input from the third sensor and (2) receiving the second input from the second sensor.

16. The non-transitory computer readable medium as defined in claim 13, wherein the instructions further cause the machine to display, via a third display, a same signal as displayed by the first display, the third display to face the first area from a location spaced apart from the first display.

17. The non-transitory computer readable medium as defined in claim 13, wherein the instructions further cause the machine to project light toward a floor of a third area in response to (1) receiving the first input from the first sensor and (2) receiving the second input from the second sensor, the third area corresponding to an intersection between the first area and the second area.

18. A method, comprising:

monitoring, with a first sensor, oncoming traffic in a first area;

monitoring, with a second sensor, oncoming traffic in a second area;

displaying, with a first display facing toward the first area, a first signal in response to (1) the first sensor not detecting the oncoming traffic in the first area and (2) the second sensor detecting the oncoming traffic in the second area; and displaying, with the first display, a second signal in response to (1) the first sensor detecting the oncoming traffic in the first area and (2) the second sensor detecting the oncoming traffic in the second area, the first signal being different than the second signal.

19. The method as defined in claim 18, further including:

monitoring, with a third sensor, the oncoming traffic in the first area, the first sensor monitoring a first zone of the first area and the third sensor monitoring a second zone of the first area, the third sensor being spaced apart from the first sensor; and displaying, with a second display facing toward the second area, the first signal in response to (1) at least one of the first or third sensors detecting the oncoming traffic in the first area and (2) the second sensor not detecting the oncoming traffic in the second area; and displaying, with the second display, the second signal in response to (1) at least one of the first or third sensors detecting the oncoming traffic in the first area and (2) the second sensor detecting the oncoming traffic in the second area.

20. The method as defined in claim 18, further including displaying, with a third display facing toward the first area, a same signal as displayed by the first display, the third display spaced apart from the first display.

* * * * *